US010398949B2

(12) United States Patent
Hayashi et al.

(10) Patent No.: US 10,398,949 B2
(45) Date of Patent: Sep. 3, 2019

(54) GOLF CLUB HEAD

(71) Applicant: SUMITOMO RUBBER INDUSTRIES, LTD., Kobe-shi, Hyogo (JP)

(72) Inventors: Kazuhiro Hayashi, Kobe (JP); Kosuke Tachibana, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 16/026,626

(22) Filed: Jul. 3, 2018

(65) Prior Publication Data

US 2019/0009140 A1 Jan. 10, 2019

(30) Foreign Application Priority Data

Jul. 5, 2017 (JP) ..... 2017-131985

(51) Int. Cl.

*A63B 53/04* (2015.01)
*A63B 102/32* (2015.01)
*A63B 71/06* (2006.01)

(52) U.S. Cl.

CPC ..... *A63B 53/0466* (2013.01); *A63B 53/04* (2013.01); *A63B 2053/0408* (2013.01); *A63B 2053/0437* (2013.01); *A63B 2053/0441* (2013.01); *A63B 2071/0694* (2013.01); *A63B 2102/32* (2015.10)

(58) Field of Classification Search

CPC ..... A63B 53/04; A63B 53/0466; A63B 2053/0441; A63B 2053/0437
USPC ..... 473/343, 324, 345, 349
See application file for complete search history.

(56) References Cited

U.S. PATENT DOCUMENTS

| | | | | |
|---|---|---|---|---|
| D643,899 | S | 8/2011 | Piniarski et al. | |
| 2012/0094782 | A1* | 4/2012 | Beach | A63B 53/0487 473/340 |
| 2013/0017901 | A1* | 1/2013 | Sargent | A63B 53/0466 473/309 |
| 2016/0375321 | A1* | 12/2016 | Greaney | A63B 53/0466 473/219 |
| 2018/0154224 | A1* | 6/2018 | Bovee | A63B 53/0466 |

* cited by examiner

*Primary Examiner* — Benjamin Layno
(74) *Attorney, Agent, or Firm* — Birch, Stewart, Kolasch & Birch, LLP

(57) ABSTRACT

A coating region 6*p* of a crown 6 has a maximum saturation portion SR1 at which a saturation is a maximum value Cmax, a high saturation region SR2 which includes the maximum saturation portion SR1 and in which a saturation difference from the saturation Cmax is not greater than 15, and a low saturation region SR3 in which a saturation difference from the saturation Cmax is greater than 15. When a straight line that passes through a face center Fc and extends in a face-back direction is defined as a straight line C, an area of a portion of the high saturation region SR2 at a toe side with respect to the straight line C is denoted by St, and an area of a portion of the high saturation region SR2 at a heel side with respect to the straight line C is denoted by Sh, then St>Sh.

17 Claims, 11 Drawing Sheets

GOLF CLUB HEAD

This application claims priority on Patent Application No. 2017-131985 filed in JAPAN on Jul. 5, 2017. The entire contents of this Japanese Patent Application are hereby incorporated by reference.

BACKGROUND OF THE INVENTION

Field of the Invention

The present invention relates to golf club heads.

Description of the Related Art

A head having a crown is known. For example, a wood type head and a hybrid type head have a crown.

Normally, the crown is colored. Normally, the crown has a single color as a whole, except local markings.

SUMMARY OF THE INVENTION

During addressing, a head is viewed by a golf player. The viewed head provides various images to the golf player. Regarding a head having a crown, the crown is conspicuous during addressing. The crown forms the outline of the head. The way in which the crown looks provides various images to the golf player. The images influence swings and further the results of shots.

On the basis of a new technical idea, the present inventors have found a head that can improve an image created during addressing. An object of the present disclosure is to provide a golf club head that is less likely to cause an uncomfortable feeling during addressing.

According to a certain aspect, a golf club head includes a hitting surface having a face center, a crown having a coating region, a sole, and a hosel hole. When a color in the coating region is represented by indexes L*, a*, and b* in a CIELAB color system and a saturation of the color is $((a^*)^2+(b^*)^2)^{1/2}$, the coating region may have a maximum saturation portion at which the saturation is a maximum value Cmax, a high saturation region which includes the maximum saturation portion and in which a saturation difference from the saturation Cmax is not greater than 15, and a low saturation region in which a saturation difference from the saturation Cmax is greater than 15. The low saturation region may surround the high saturation region. In a plan view of the head, when a straight line that passes through the face center and extends in a face-back direction is defined as a straight line C, an area of a portion of the high saturation region at a toe side with respect to the straight line C is denoted by St, and an area of a portion of the high saturation region at a heel side with respect to the straight line C is denoted by Sh, the area St may be larger than the area Sh. St/Sh can be not less than 1.5.

According to another aspect, when a lightness of the color in the coating region is the index L*, the coating region may have a maximum lightness portion at which the lightness is a maximum value Lmax, a high lightness region which includes the maximum lightness portion and in which a lightness difference from the lightness Lmax is not greater than 8.0, and a low lightness region in which a lightness difference from the lightness Lmax is greater than 8.0. The low lightness region may surround the high lightness region. In the plan view of the head, when an area of a portion of the high lightness region at the toe side with respect to the straight line C is denoted by Mt and an area of a portion of the high lightness region at the heel side with respect to the straight line C is denoted by Mh, the area Mt may be larger than the area Mh. Mt/Mh can be not less than 1.5.

According to another aspect, a golf club head includes a hitting surface having a face center, a crown having a coating region, a sole, and a hosel hole. When a color in the coating region is represented by indexes L*, a*, and b* in a CIELAB color system and a lightness of the color is L*, the coating region may have a maximum lightness portion at which the lightness is a maximum value Lmax, a high lightness region which includes the maximum lightness portion and in which a lightness difference from the lightness Lmax is not greater than 8.0, and a low lightness region in which a lightness difference from the lightness Lmax is greater than 8.0. The low lightness region may surround the high lightness region. In a plan view of the head, when a straight line that passes through the face center and extends in a face-back direction is defined as a straight line C, an area of a portion of the high lightness region at a toe side with respect to the straight line C is denoted by Mt, and an area of a portion of the high lightness region at a heel side with respect to the straight line C is denoted by Mh, the area Mt may be larger than the area Mh. Mt/Mh can be not less than 1.5.

According to another aspect, when a saturation of the color in the coating region is $((a^*)^2+(b^*)^2)^{1/2}$, the coating region may have a maximum saturation portion at which the saturation is a maximum value Cmax, a high saturation region which includes the maximum saturation portion and in which a saturation difference from the saturation Cmax is not greater than 15, and a low saturation region in which a saturation difference from the saturation Cmax is greater than 15. The low saturation region may surround the high saturation region. In the plan view of the head, when an area of a portion of the high saturation region at the toe side with respect to the straight line C is denoted by St, and an area of a portion of the high saturation region at the heel side with respect to the straight line C is denoted by Sh, the area St may be larger than the area Sh. St/Sh can be not less than 1.5.

A head area at the toe side with respect to the straight line C is denoted by Ht and a head area at the heel side with respect to the straight line C is denoted by Hh. According to another aspect, Hh/(Ht+Hh) can be not less than 0.40.

The straight line C has a point of intersection Pf with an outline at a face side of the head, a point of intersection Pb with an outline at a back side of the head, and a midpoint Pm of a line segment connecting the point of intersection Pf and the point of intersection Pb to each other, and the midpoint Pm is defined as a crown center. A straight line that passes through the crown center and extends in a toe-heel direction is defined as a straight line V. The straight line V has a point of intersection Pt with an outline at the toe side of the head and a point of intersection Ph with an outline at the heel side of the head. A length of a line segment connecting the crown center and the point of intersection Pt to each other is denoted by Lt, and a length of a line segment connecting the crown center and the point of intersection Ph to each other is denoted by Lh. According to another aspect, Lh/(Lh+Lt) can be not less than 0.40.

A line segment connecting a point of intersection Pb of an outline at a back side of the head and the straight line C and an opening center point Pz of the hosel hole to each other is defined as a line segment D, and a length of the line segment D is denoted by L1. A point that is located on an outline of the head and at the heel side with respect to the line segment D and farthest from the line segment D is defined as a point Ps, and a distance between the point Ps and the line segment D is denoted by L2. According to another aspect, L2/L1 can be not less than 0.140.

DESCRIPTION OF THE PREFERRED EMBODIMENTS

The following will describe embodiments in detail with appropriate reference to the drawings.

In the present application, a reference state, a reference vertical plane, a face-back direction, a toe-heel direction, an up-down direction, a face center, and a plan view are defined.

Figure 11:
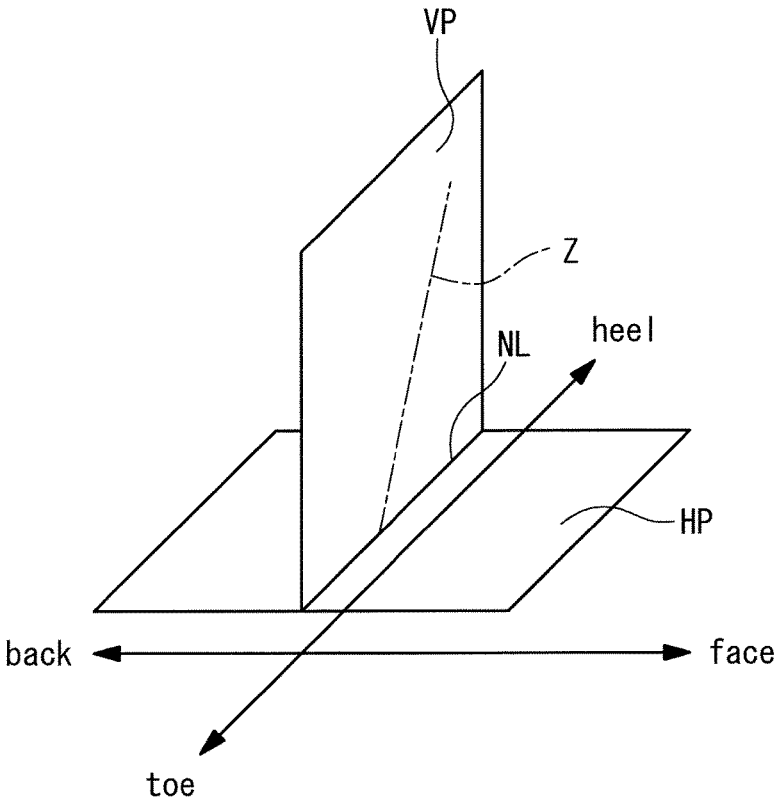
FIG. 11 is a schematic diagram for describing a reference state.

A state where a head 2 is placed on a horizontal plane HP at a predetermined lie angle and real loft angle is defined as the reference state. As shown in FIG. 11, in the reference state, a plane VP perpendicular to the horizontal plane HP includes a center line Z of a hosel hole. The plane VP is defined as the reference vertical plane. The predetermined lie angle and real loft angle are described, for example, in a product catalogue.

In the present application, the toe-heel direction is the direction of a line of intersection NL of the reference vertical plane VP and the horizontal plane HP (see FIG. 11).

In the present application, the face-back direction is a direction that is perpendicular to the toe-heel direction and parallel to the horizontal plane HP.

In the present application, the up-down direction is a direction that is perpendicular to the toe-heel direction and perpendicular to the face-back direction. In other words, in the present application, the up-down direction is a direction that is perpendicular to the horizontal plane HP.

In the present application, a face center Fc is defined. The face center Fc is determined as follows. First, an arbitrary point Pr roughly in the vicinity of the center of a face surface in the up-down direction and the toe-heel direction is selected. Next, a plane that passes through the point Pr, extends along the direction of a line normal to the face surface at the point Pr, and is parallel to the toe-heel direction is determined. The line of intersection of the plane and the face surface is drawn, and a midpoint Px thereof is determined. Next, a plane that passes through the midpoint Px, extends along the direction of a line normal to the face surface at the point Px, and is parallel to the up-down direction is determined. The line of intersection of the plane and the face surface is drawn, and a midpoint Py thereof is determined. Next, a plane that passes through the midpoint Py, extends along the direction of a line normal to the face surface at the point Py, and is parallel to the toe-heel direction is determined. The line of intersection of the plane and the face surface is drawn, and a midpoint Px thereof is newly determined. Next, a plane that passes through the new midpoint Px, extends along the direction of a line normal to the face surface at the point Px, and is parallel to the up-down direction is determined. The line of intersection of the plane and the face surface is drawn, and a midpoint Py thereof is newly determined. By repeating this process, Px and Py are sequentially determined. During the repeat of this process, when the distance between a new midpoint Py and the immediately previous midpoint Py becomes 0.5 mm or less for the first time, the new position Py (the final position Py) is set as the face center Fc.

In the present application, a plan view means a top view of a head. The plan view is a parallel projection view and is an orthographical view to a plane parallel to the horizontal plane HP. The direction of projection is the up-down direction. The requirements regarding the crown of the present application are each a requirement in the plan view.

1. First Embodiment

Figure 1:
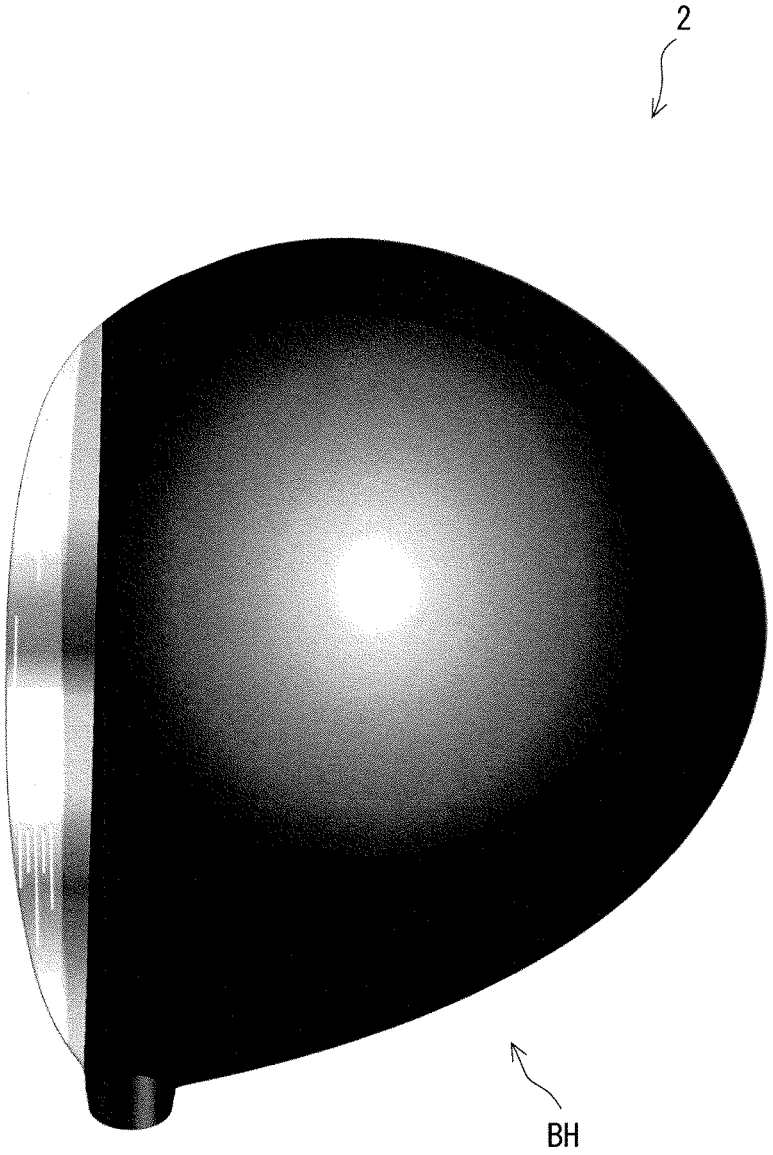
FIG. 1 is a plan view of a golf club head according to a first embodiment.
Figure 2:
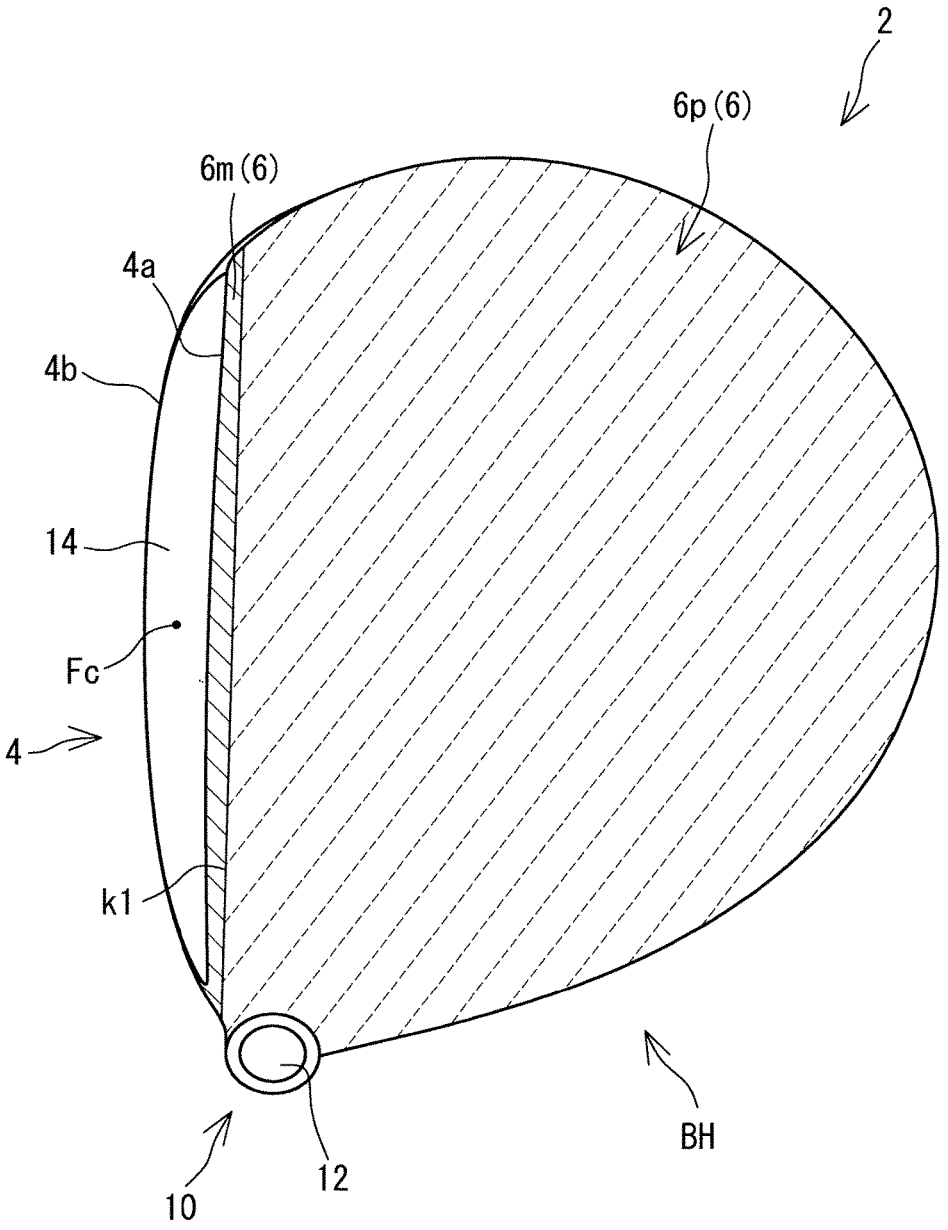
FIG. 2 is the same plan view as FIG. 1 and shows a coating region and a non-coating region.

FIG. 1 is a plan view of a golf club head 2 according to a first embodiment. In FIG. 1, the color of a crown is shown in gray scale. In fact, the color of the crown can have coloration. FIG. 2 is the same plan view as FIG. 1. Note that FIG. 2 is a line diagram.

The head 2 has a face 4, a crown 6, a sole (not shown), and a hosel 10. The face 4 has a hitting surface 14. The hitting surface 14 has a face center Fc. The crown 6 extends from an upper edge 4*a* of the face 4 toward the head rear. The sole extends from a lower edge 4*b* of the face 4 toward the head rear. The hosel 10 has a hosel hole 12.

The head 2 is hollow. The head 2 is a wood type golf club head. The head 2 is the head of a No. 1 wood (driver).

The surface (outer surface) of the crown 6 is a curved surface. The surface of the crown 6 is a curved surface that projects toward the outer side of the head 2. The entire surface of the crown 6 is continuously smooth.

Substantially the entirety of the surface of the crown 6 is coated. The coated region is referred to as coating region 6*p*. Substantially the entirety of the surface of the crown 6 is the coating region 6*p*. More precisely, the crown 6 has the coating region 6*p* and a non-coating region 6*m*. In FIG. 2, the coating region 6*p* is shown by hatching with broken lines, and the non-coating region 6*m* is shown by hatching with solid lines. The non-coating region 6*m* is adjacent to the face side of the coating region 6*p*.

In the plan view, the area of the coating region 6*p* accounts for 95% or greater of the area of the crown 6. A boundary k1 between the coating region 6*p* and the non-coating region 6*m* extends substantially along the upper edge 4*a* of the face 4. The non-coating region 6*m* is a region between the boundary k1 and the upper edge 4*a*.

The boundary k1 extends substantially along the hitting surface 14. The boundary k1 serves to clarify the direction in which the hitting surface 14 faces. The boundary k1 contributes to ease of addressing. The non-coating region 6*m* extends substantially along the hitting surface 14. The non-coating region 6*m* serves to clarify the direction in which the hitting surface 14 faces. The non-coating region 6*m* contributes to ease of addressing.

As a matter of course, the entirety of the surface of the crown 6 may be the coating region 6*p*.

Figure 3:
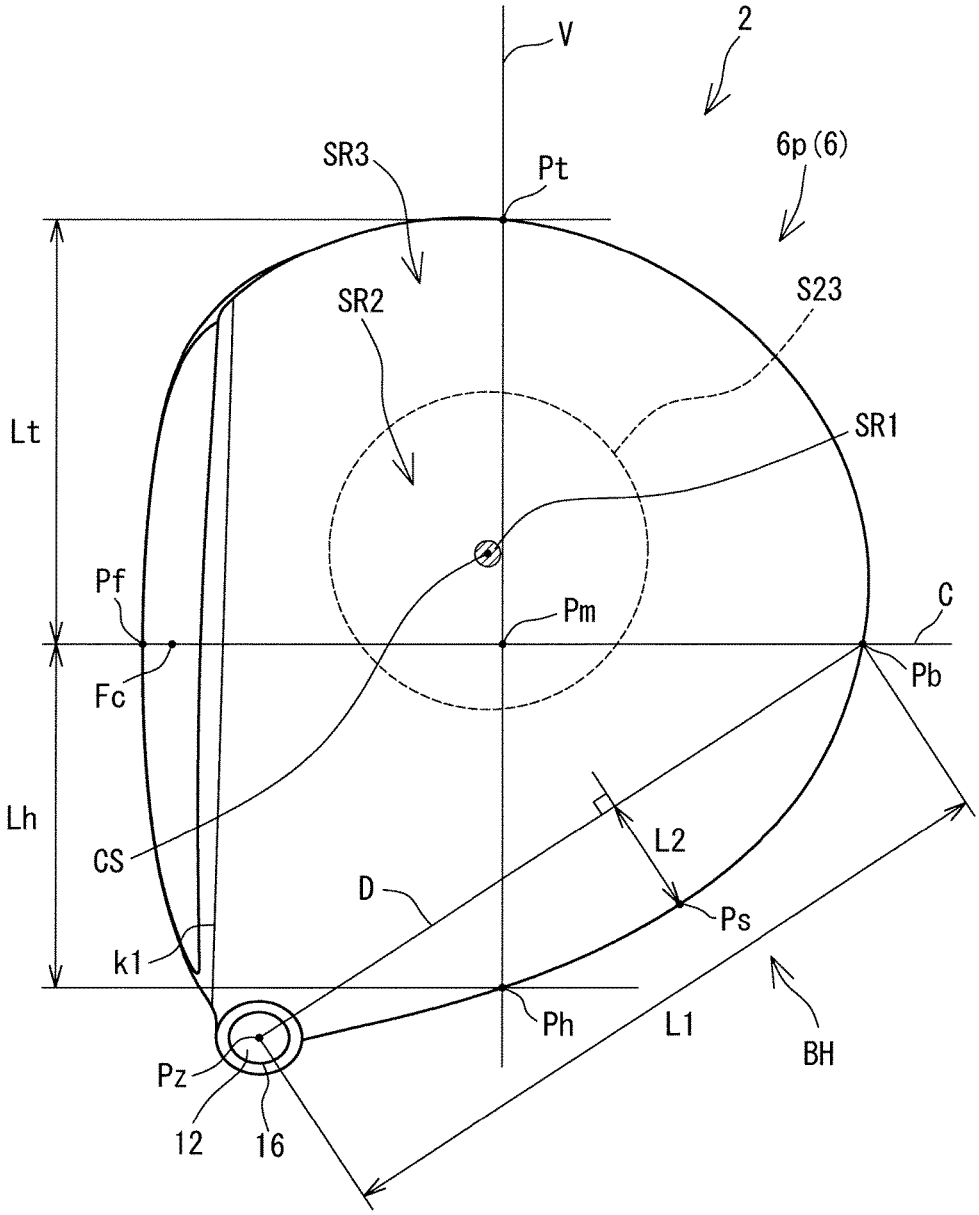
FIG. 3 is the same plan view as FIG. 1 and shows a saturation contour boundary.

Similar to FIG. 2, FIG. 3 is a plan view of the head 2. In the coating region 6*p*, the saturation changes. The coating region 6*p* has a maximum saturation portion SR1, a high saturation region SR2, and a low saturation region SR3.

The maximum saturation portion SR1 is a portion of the coating region 6*p* at which the saturation is a maximum value Cmax. The maximum saturation portion SR1 may be a region or may be a point. The maximum saturation portion SR1 has a centroid CS.

The high saturation region SR2 is a region in which the saturation difference from the saturation Cmax is not greater than 15. In FIG. 3, a broken line represents a saturation contour boundary S23 at which the saturation difference from the saturation Cmax is 15. The saturation contour boundary S23 is an endless curve. The region inside the saturation contour boundary S23 is the high saturation region SR2. The high saturation region SR2 includes the maximum saturation portion SR1. The high saturation region SR2 includes the saturation contour boundary S23.

The saturation at the saturation contour boundary S23 is [Cmax−15]. In the present embodiment, the saturation contour boundary S23 is a contour line. The saturation contour boundary S23 may not be a contour line. The saturation contour boundary S23 may be a region. The saturation contour boundary S23 may not be present. For example, when the color does not change by gradation and the saturation changes discontinuously (stepwise), the saturation contour boundary S23 may not be present.

The low saturation region SR3 is a region in which the saturation difference from the saturation Cmax is greater than 15. In other words, the saturation in the low saturation region SR3 is less than [Cmax−15]. The region outside the saturation contour boundary S23 is the low saturation region SR3. The low saturation region SR3 does not include the saturation contour boundary S23.

The low saturation region SR3 surrounds the high saturation region SR2. The coating region 6*p* is occupied by only the high saturation region SR2 and the low saturation region SR3. The low saturation region SR3 extends to the back-side edge of the head 2. The outline of the low saturation region SR3 coincides with the outline of the coating region 6*p*.

The maximum value of the saturation in the low saturation region SR3 is lower than the minimum value of the saturation in the high saturation region SR2.

Markings, characters, or the like may be provided on the crown but are excluded from the maximum saturation portion SR1, the high saturation region SR2, and the low saturation region SR3.

As shown in FIG. 1, the change in saturation from the maximum saturation portion SR1 to the low saturation region SR3 is continuous. The saturation contour boundary S23 is not visually recognized.

Figure 4:
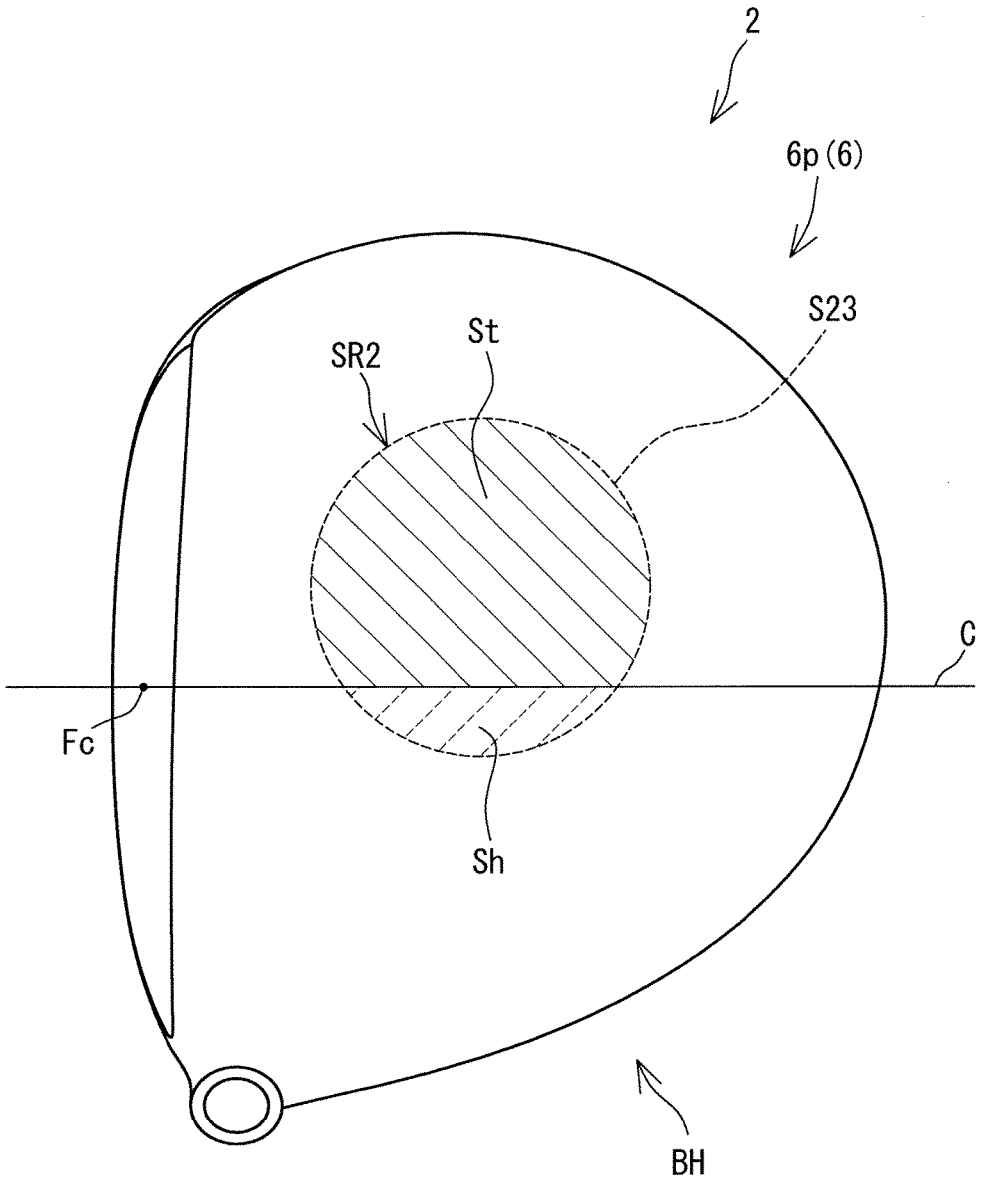
FIG. 4 is the same plan view as FIG. 1 and shows a high saturation region.

Similar to FIG. 3, FIG. 4 is a plan view of the head 2. In FIG. 4, the high saturation region SR2 is shown by hatching.

In the plan view of the head 2, a straight line that passes through the face center Fc and extends in the face-back direction is defined as a straight line C. The area of a portion of the high saturation region SR2 at the toe side with respect to the straight line C is denoted by St. In FIG. 4, the area of a portion shown by hatching with solid lines is St. The area of a portion of the high saturation region SR2 at the heel side with respect to the straight line C is denoted by Sh. In FIG. 4, the area of a portion shown by hatching with broken lines is Sh. In the present embodiment, the area St is larger than the area Sh. Thus, the high saturation region SR2 appears to be located at the toe side.

2. Second Embodiment

Figure 5:
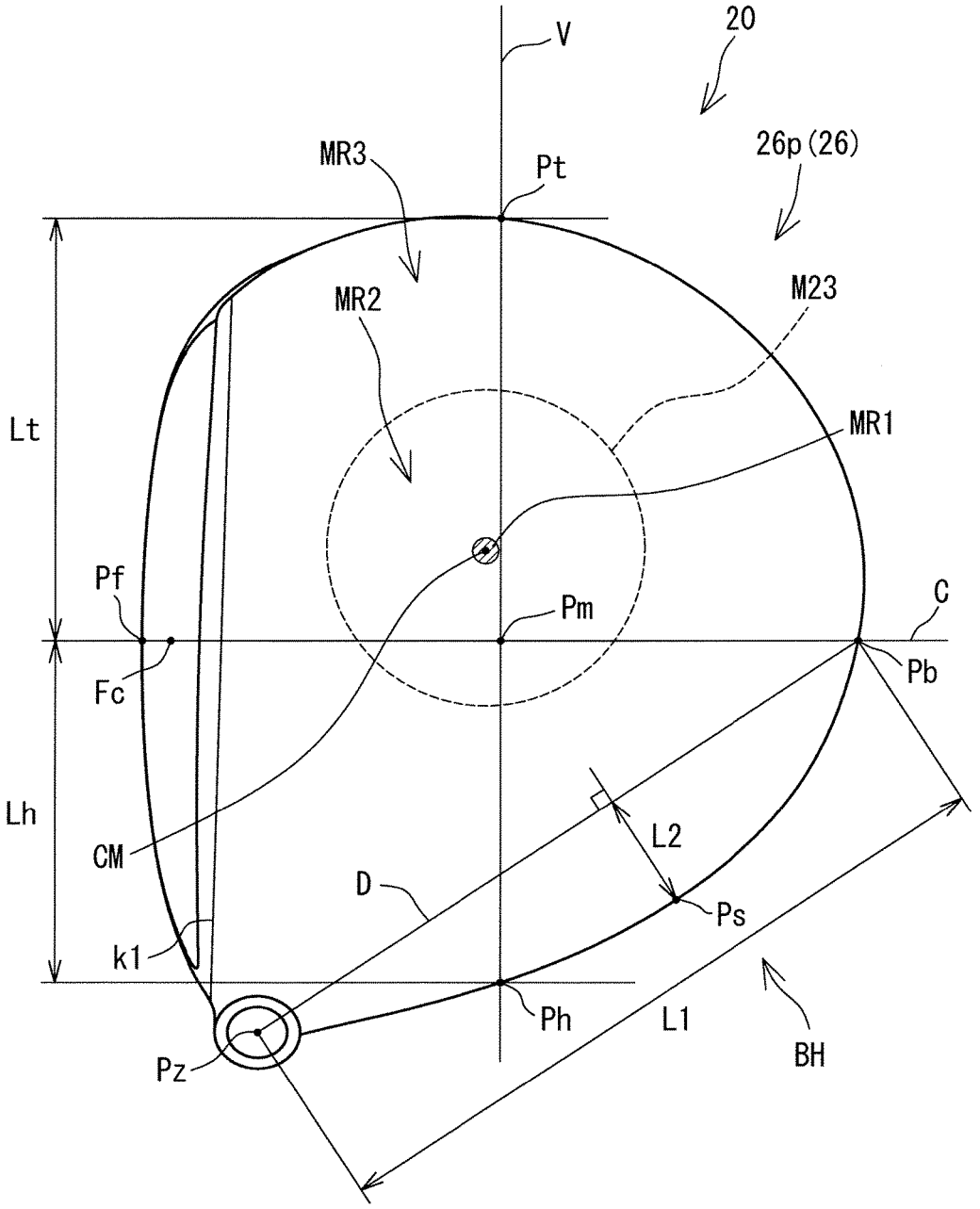
FIG. 5 is a plan view of a golf club head according to a second embodiment.

FIG. 5 is a plan view of a golf club head 20 according to a second embodiment. Although not shown, a crown 26 of the head 20 is subjected to gradation coating. The head 20 has the same structure as the above-described head 2. A coating region 26*p* is also the same as the coating region 6*p* of the head 2. The head 20 is the head of a No. 1 wood (driver).

In the coating region 26*p*, the lightness changes. The coating region 26*p* has a maximum lightness portion MR1, a high lightness region MR2, and a low lightness region MR3.

The maximum lightness portion MR1 is a portion of the coating region 6*p* at which the lightness is a maximum value Lmax. The maximum lightness portion MR1 may be a region or may be a point. The maximum lightness portion MR1 has a centroid CM.

The high lightness region MR2 is a region in which the lightness difference from the lightness Lmax is not greater than 8.0. In FIG. 5, a broken line represents a lightness contour boundary M23 at which the lightness difference from the lightness Lmax is 8.0. The lightness contour boundary M23 is an endless curve. The region inside the lightness contour boundary M23 is the high lightness region MR2. The high lightness region MR2 includes the maximum lightness portion MR1. The high lightness region MR2 includes the lightness contour boundary M23.

The lightness at the lightness contour boundary M23 is [Lmax−8.0]. In the present embodiment, the lightness contour boundary M23 is a contour line. The lightness contour boundary M23 may not be a contour line. The lightness contour boundary M23 may be a region. The lightness contour boundary M23 may not be present. For example, when the color does not change by gradation and the lightness changes discontinuously (stepwise), the lightness contour boundary M23 may not be present.

The low lightness region MR3 is a region in which the lightness difference from the lightness Lmax is greater than 8.0. In other words, the lightness in the low lightness region MR3 is less than [Lmax−8.0]. The region outside the lightness contour boundary M23 is the low lightness region MR3. The low lightness region MR3 does not include the lightness contour boundary M23.

The low lightness region MR3 surrounds the high lightness region MR2. The coating region 26*p* is occupied by only the high lightness region MR2 and the low lightness region MR3. The low lightness region MR3 extends to the back-side edge of the head 20. The outline of the low lightness region MR3 coincides with the outline of the coating region 26*p*.

The maximum value of the lightness in the low lightness region MR3 is lower than the minimum value of the lightness in the high lightness region MR2.

Markings, characters, or the like may be provided on the crown but are excluded from the maximum lightness portion MR1, the high lightness region MR2, and the low lightness region MR3.

The change in lightness from the maximum lightness portion MR1 to the low lightness region MR3 is continuous. The lightness contour boundary M23 is not visually recognized.

Figure 6:
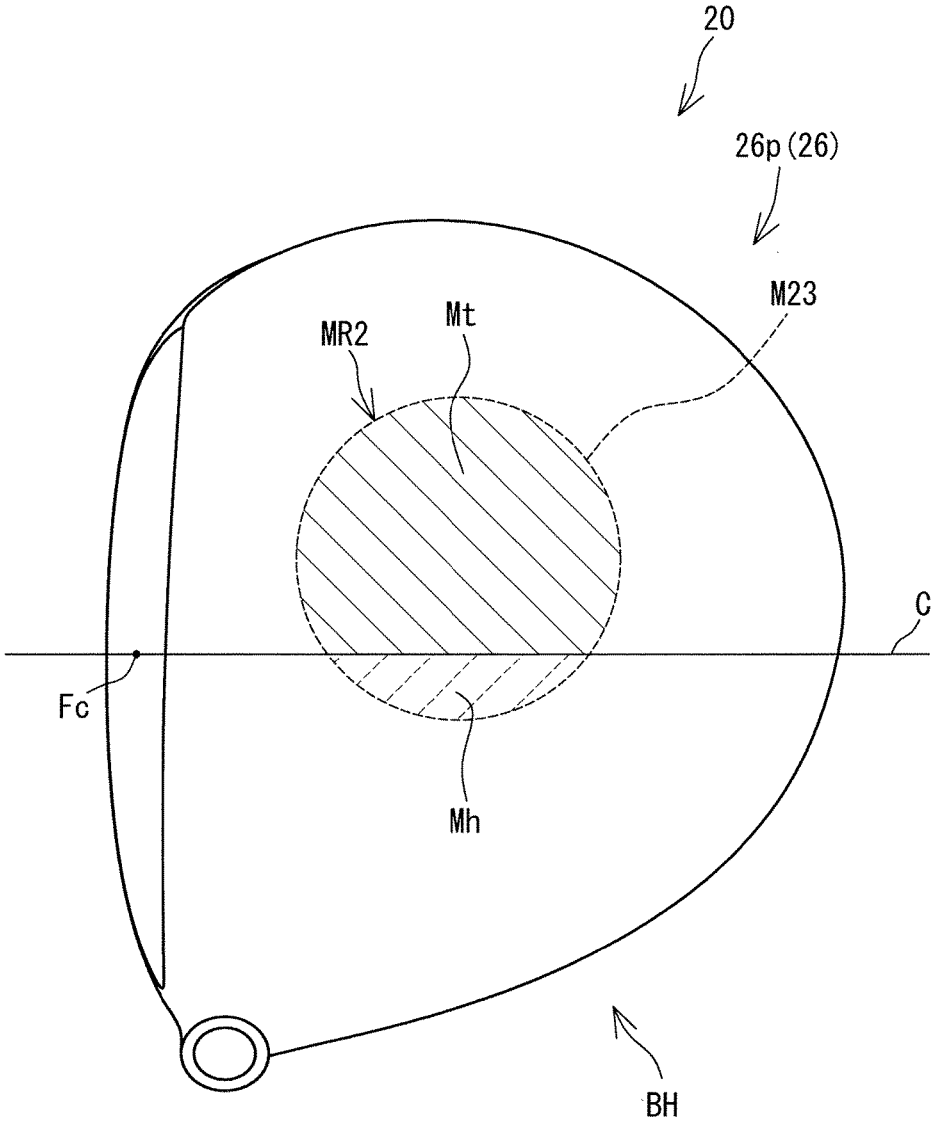
FIG. 6 is the same plan view as FIG. 5 and shows a high lightness region.

Similar to FIG. 5, FIG. 6 is a plan view of the head 20. In FIG. 6, the high lightness region MR2 is shown by hatching.

In the plan view of the head 20, the area of a portion of the high lightness region MR2 at the toe side with respect to the straight line C is denoted by Mt. In FIG. 6, the area of a portion shown by hatching with solid lines is Mt. The area of a portion of the high lightness region MR2 at the heel side with respect to the straight line C is denoted by Mh. In FIG. 6, the area of a portion shown by hatching with broken lines is Mh. In the present embodiment, the area Mt is larger than the area Mh. Thus, the high lightness region MR2 appears to be located at the toe side.

Figure 7:
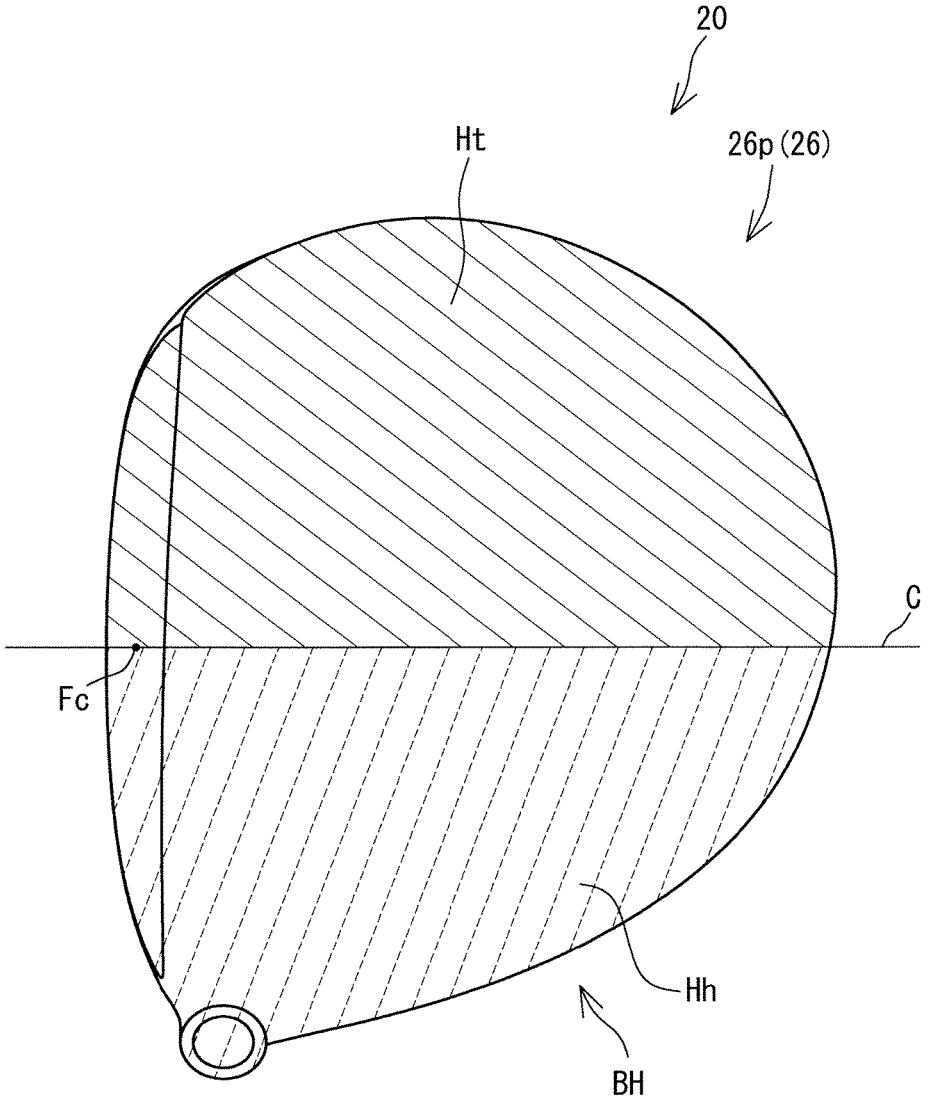
FIG. 7 is the same plan view as FIG. 5 and shows two head areas obtained as a result of division by a straight line C.

FIG. 7 is also a plan view of the head 20. The head 20 in the plan view is divided into two sections by the aforementioned straight line C. Of the entire projection area of the head 20, the head area at the toe side with respect to the straight line C is denoted by Ht, and the head area at the heel side with respect to the straight line C is denoted by Hh. The area of a region hatched with solid lines is Ht. The area of a region hatched with broken lines is Hh. The sum [Ht+Hh] of Ht and Hh is the total area of the head 20 in the plan view. In the case of a head shape in which a back heel portion BH bulges, the area Hh increases, so that Hh/(Ht+Hh) increases.

3. Third Embodiment

Figure 8:
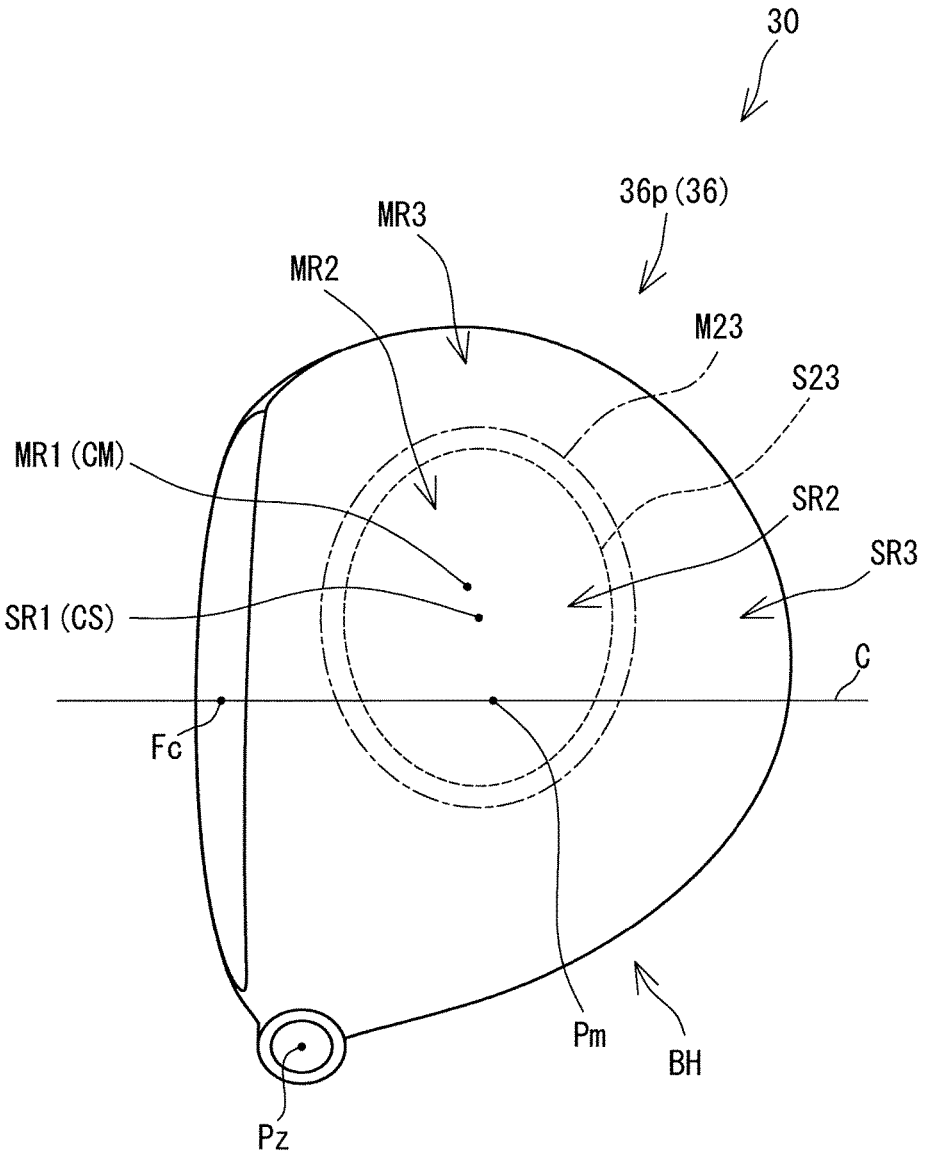
FIG. 8 is a plan view of a golf club head according to a third embodiment.

FIG. 8 is a plan view of a golf club head 30 according to a third embodiment. Although not shown, a crown 36 of the head 30 is subjected to gradation coating. The crown 36 has a coating region 36*p*. In the present embodiment, the entirety of the crown 36 is the coating region 36*p*. The head 30 is the head of a fairway wood (No. 3 wood).

In the coating region 36*p*, the lightness changes. The coating region 36*p* has a maximum lightness portion MR1, a high lightness region MR2, and a low lightness region MR3.

The maximum lightness portion MR1 is a portion of the coating region 36*p* at which the lightness is a maximum value Lmax. In the present embodiment, the maximum lightness portion MR1 is a point.

The high lightness region MR2 is a region in which the lightness difference from the lightness Lmax is not greater than 8.0. In FIG. 8, an alternate long and short dash line represents a lightness contour boundary M23 at which the lightness difference from the lightness Lmax is 8.0. The lightness contour boundary M23 is an endless curve. The region inside the lightness contour boundary M23 is the high lightness region MR2. The high lightness region MR2 includes the maximum lightness portion MR1. The high lightness region MR2 includes the lightness contour boundary M23.

The lightness at the lightness contour boundary M23 is [Lmax−8.0]. In the present embodiment, the lightness contour boundary M23 is a contour line.

The low lightness region MR3 is a region in which the lightness difference from the lightness Lmax is greater than 8.0. The region outside the lightness contour boundary M23 is the low lightness region MR3. The low lightness region MR3 does not include the lightness contour boundary M23.

The low lightness region MR3 surrounds the high lightness region MR2. The coating region 36*p* is occupied by only the high lightness region MR2 and the low lightness region MR3. The low lightness region MR3 extends to the back-side edge of the head 30. The outline of the low lightness region MR3 coincides with the outline of the coating region 36*p*.

The change in lightness from the maximum lightness portion MR1 to the low lightness region MR3 is continuous. The lightness contour boundary M23 is not visually recognized.

In the coating region 36*p*, the saturation changes together with the lightness. The coating region 36*p* has a maximum saturation portion SR1, a high saturation region SR2, and a low saturation region SR3.

The maximum saturation portion SR1 is a portion of the coating region 36*p* at which the saturation is a maximum value Cmax. In the present embodiment, the maximum saturation portion SR1 is a point. The position of the maximum saturation portion SR1 is different from the position of the maximum lightness portion MR1. The position of the maximum saturation portion SR1 may coincide with the position of the maximum lightness portion MR1.

The high saturation region SR2 is a region in which the saturation difference from the saturation Cmax is not greater than 15. In FIG. 8, a broken line represents a saturation contour boundary S23 at which the saturation difference from the saturation Cmax is 15. The saturation contour boundary S23 is an endless curve. The region inside the saturation contour boundary S23 is the high saturation region SR2. The high saturation region SR2 includes the maximum saturation portion SR1. The high saturation region SR2 includes the saturation contour boundary S23.

The saturation at the saturation contour boundary S23 is [Cmax−15]. In the present embodiment, the saturation contour boundary S23 is a contour line.

The low saturation region SR3 is a region in which the saturation difference from the saturation Cmax is greater than 15. The region outside the saturation contour boundary S23 is the low saturation region SR3. The low saturation region SR3 does not include the saturation contour boundary S23.

The low saturation region SR3 surrounds the high saturation region SR2. The coating region 36*p* is occupied by only the high saturation region SR2 and the low saturation region SR3. The low saturation region SR3 extends to the back-side edge of the head 30. The outline of the low saturation region SR3 coincides with the outline of the coating region 36*p*.

The change in saturation from the maximum saturation portion SR1 to the low saturation region SR3 is continuous. The saturation contour boundary S23 is not visually recognized.

In the present embodiment, the position of the saturation contour boundary S23 is different from the position of the lightness contour boundary M23. When both the saturation contour boundary S23 and the lightness contour boundary M23 are present, the positions of the saturation contour boundary S23 and the lightness contour boundary M23 do not coincide with each other in many cases. As a matter of course, the saturation contour boundary S23 and the lightness contour boundary M23 may coincide with each other.

In the present embodiment, the high lightness region MR2 is substantially elliptical. The width in the toe-heel direction of the high lightness region MR2 is larger than the width in the face-back direction of the high lightness region MR2. In the present embodiment, the high saturation region SR2 is substantially elliptical. The width in the toe-heel direction of the high saturation region SR2 is larger than the width in the face-back direction of the high saturation region SR2.

4. Fourth Embodiment

Figure 9:
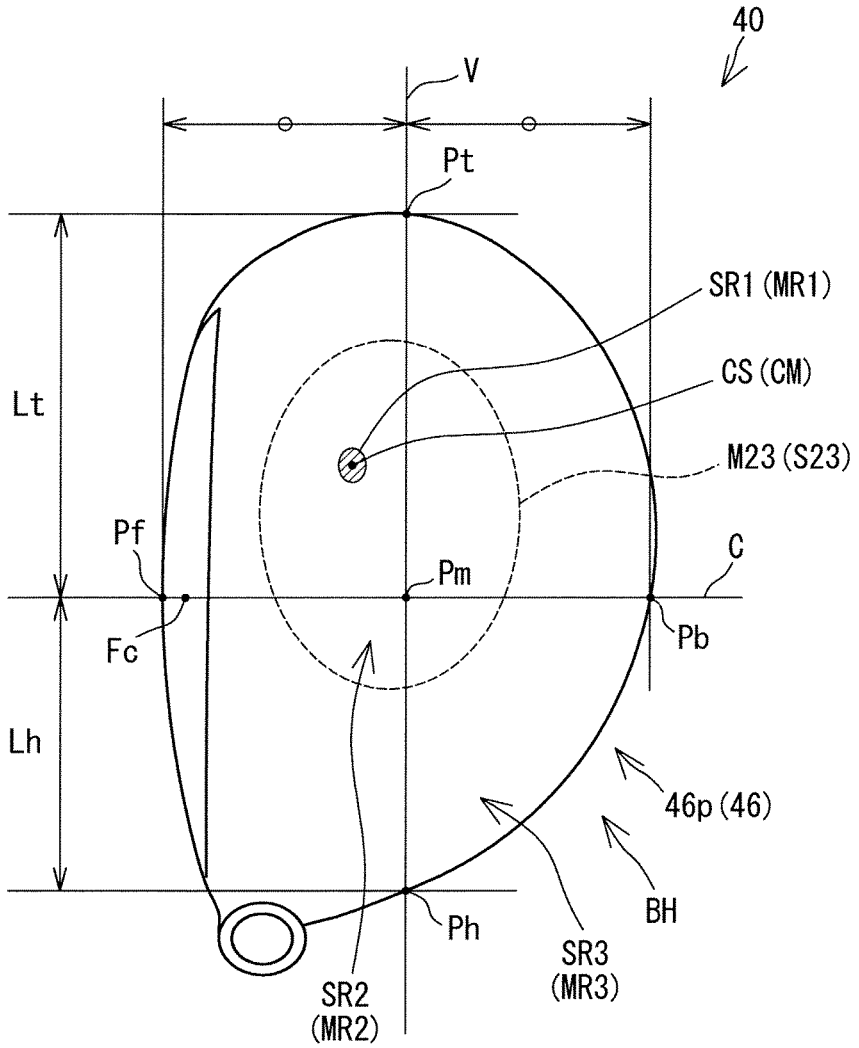
FIG. 9 is a plan view of a golf club head according to a fourth embodiment.

FIG. 9 is a plan view of a golf club head 40 according to a fourth embodiment. Although not shown, a crown 46 of the head 40 is subjected to gradation coating. The crown 46 has a coating region 46*p*. In the present embodiment, the entirety of the crown 46 is the coating region 46*p*. The head 40 is the head of a fairway wood.

In the coating region 46*p*, the lightness changes. The coating region 46*p* has a maximum lightness portion MR1, a high lightness region MR2, and a low lightness region MR3.

The maximum lightness portion MR1 is a portion of the coating region 46*p* at which the lightness is a maximum value Lmax. In the present embodiment, the maximum lightness portion MR1 is a region. The maximum lightness portion MR1 is shown by hatching.

The high lightness region MR2 is a region in which the lightness difference from the lightness Lmax is not greater than 8.0. In FIG. 9, a broken line represents a lightness contour boundary M23 at which the lightness difference from the lightness Lmax is 8.0. The lightness contour boundary M23 is an endless curve. The region inside the lightness contour boundary M23 is the high lightness region MR2. The high lightness region MR2 includes the maximum lightness portion MR1. The high lightness region MR2 includes the lightness contour boundary M23.

The lightness at the lightness contour boundary M23 is [Lmax−8.0]. In the present embodiment, the lightness contour boundary M23 is a contour line.

The low lightness region MR3 is a region in which the lightness difference from the lightness Lmax is greater than 8.0. The region outside the lightness contour boundary M23 is the low lightness region MR3. The low lightness region MR3 does not include the lightness contour boundary M23.

In the coating region 46*p*, the saturation changes together with the lightness. The coating region 46*p* has a maximum saturation portion SR1, a high saturation region SR2, and a low saturation region SR3.

The maximum saturation portion SR1 is a portion of the coating region 46*p* at which the saturation is a maximum value Cmax. In the present embodiment, the maximum saturation portion SR1 is a region. The maximum saturation portion SR1 is shown by hatching. The position of the maximum saturation portion SR1 coincides with the position of the maximum lightness portion MR1.

The high saturation region SR2 is a region in which the saturation difference from the saturation Cmax is not greater than 15. In FIG. 9, the broken line also represents a saturation contour boundary S23 at which the saturation difference from the saturation Cmax is 15. The saturation contour boundary S23 is an endless curve. The region inside the saturation contour boundary S23 is the high saturation region SR2. The high saturation region SR2 includes the maximum saturation portion SR1. The high saturation region SR2 includes the saturation contour boundary S23.

The saturation at the saturation contour boundary S23 is [Cmax−15]. In the present embodiment, the saturation contour boundary S23 is a contour line.

The low saturation region SR3 is a region in which the saturation difference from the saturation Cmax is greater than 15. The region outside the saturation contour boundary S23 is the low saturation region SR3. The low saturation region SR3 does not include the saturation contour boundary S23.

In the present embodiment, the position of the saturation contour boundary S23 coincides with the position of the lightness contour boundary M23.

In the present embodiment, the high lightness region MR2 is substantially elliptical. The width in the toe-heel direction of the high lightness region MR2 is larger than the width in the face-back direction of the high lightness region MR2. In the present embodiment, the high saturation region SR2 is substantially elliptical. The width in the toe-heel direction of the high saturation region SR2 is larger than the width in the face-back direction of the high saturation region SR2.

5. Fifth Embodiment

Figure 10:
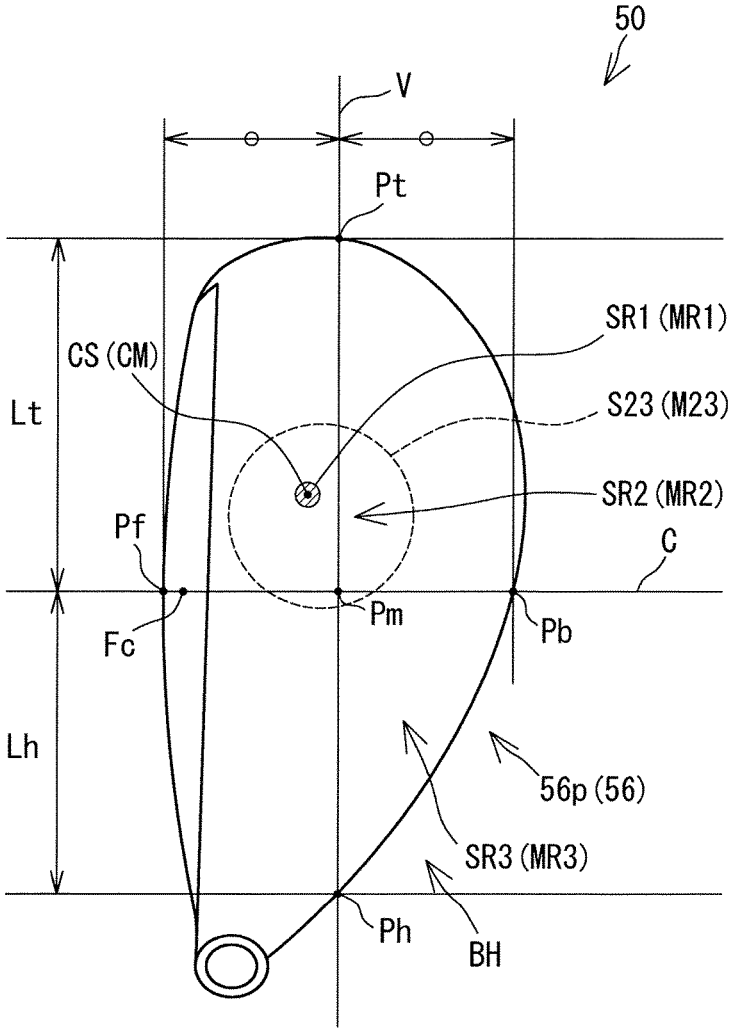
FIG. 10 is a plan view of a golf club head according to a fifth embodiment.

FIG. 10 is a plan view of a golf club head 50 according to a fifth embodiment. Although not shown, a crown 56 of the head 50 is subjected to gradation coating. The crown 56 has a coating region 56*p*. In the present embodiment, the entirety of the crown 56 is the coating region 56*p*. The head 50 is a hybrid type head.

In the coating region 56*p*, the lightness changes. The coating region 56*p* has a maximum lightness portion MR1, a high lightness region MR2, and a low lightness region MR3.

The maximum lightness portion MR1 is a portion of the coating region 56*p* at which the lightness is a maximum value Lmax. In the present embodiment, the maximum lightness portion MR1 is a region. The maximum lightness portion MR1 is shown by hatching.

The high lightness region MR2 is a region in which the lightness difference from the lightness Lmax is not greater than 8.0. In FIG. 10, a broken line represents a lightness contour boundary M23 at which the lightness difference from the lightness Lmax is 8.0. The lightness contour boundary M23 is an endless curve. The region inside the lightness contour boundary M23 is the high lightness region MR2. The high lightness region MR2 includes the maximum lightness portion MR1. The high lightness region MR2 includes the lightness contour boundary M23.

The lightness at the lightness contour boundary M23 is [Lmax−8.0]. In the present embodiment, the lightness contour boundary M23 is a contour line.

The low lightness region MR3 is a region in which the lightness difference from the lightness Lmax is greater than 8.0. The region outside the lightness contour boundary M23 is the low lightness region MR3. The low lightness region MR3 does not include the lightness contour boundary M23.

In the coating region 56*p*, the saturation changes together with the lightness. The coating region 56*p* has a maximum saturation portion SR1, a high saturation region SR2, and a low saturation region SR3.

The maximum saturation portion SR1 is a portion of the coating region 56*p* at which the saturation is a maximum value Cmax. In the present embodiment, the maximum saturation portion SR1 is a region. The maximum saturation portion SR1 is shown by hatching. The position of the maximum saturation portion SR1 coincides with the position of the maximum lightness portion MR1.

The high saturation region SR2 is a region in which the saturation difference from the saturation Cmax is not greater than 15. In FIG. 10, the broken line also represents a saturation contour boundary S23 at which the saturation difference from the saturation Cmax is 15. The saturation contour boundary S23 is an endless curve. The region inside the saturation contour boundary S23 is the high saturation region SR2. The high saturation region SR2 includes the maximum saturation portion SR1. The high saturation region SR2 includes the saturation contour boundary S23.

The saturation at the saturation contour boundary S23 is [Cmax−15]. In the present embodiment, the saturation contour boundary S23 is a contour line.

The low saturation region SR3 is a region in which the saturation difference from the saturation Cmax is greater than 15. The region outside the saturation contour boundary S23 is the low saturation region SR3. The low saturation region SR3 does not include the saturation contour boundary S23.

In the present embodiment, the position of the saturation contour boun dary S23 coincides with the position of the lightness contour boundary M23.

In the present embodiment, the high lightness region MR2 is substantially circular. The width in the toe-heel direction of the high lightness region MR2 is equal to the width in the face-back direction of the high lightness region MR2. In the present embodiment, the high saturation region SR2 is substantially circular. The width in the toe-heel direction of the high saturation region SR2 is equal to the width in the face-back direction of the high saturation region SR2.

[6. Lightness and Saturation: Indexes L*, and b* in CIELAB Color System]

A color can be represented by objective numeric values using indexes L*, a*, and b* in the CIELAB color system. The indexes L*, a*, and b* are calculated by the following mathematical formulas.

$$L^*=116(Y/Yn)^{1/3}-16$$

$$a^*=500((X/Xn)^{1/3}-(Y/Yn)^{1/3})$$

$$b^*=200((Y/Yn)^{1/3}-(Z/Zn)^{1/3})$$

In these mathematical formulas, X, Y, and Z are tristimulus values in an XYZ color system, and Xn, Yn, and Zn are tristimulus values of a perfect reflecting diffuser. The CIELAB color system is a standard specified by the International Commission on Illumination (CIE) in 1976. In Japan, the CIELAB color system is used in "JIS Z 8729". L* is an index of lightness. a* and b* are indexes related to hue and saturation. For a*, a negative value indicates green, and a positive value indicates red. For b*, a negative value indicates blue, and a positive value indicates yellow. The measurement of the indexes is conducted by using the spectrophotometer "CM-3500d" manufactured by Konica Minolta, Inc. The measurement is conducted while a light receiver is brought into contact with the surface of an object. As a light source, "a standard light $D_{65}$" is used. The color temperature of the light source is 6504 k. As a spectral sensitivity, "a view angle of 2°" is used. As a hole diameter, 3 mm is used. When accurate measurement cannot be conducted for a reason such as the surface of the object being a curved surface, a plane sample in which the same color as the object is reproduced on a plane can be measured.

In the present application, the lightness is the value of L*. The saturation is calculated by the following mathematical formula.

$$\text{Saturation}=[(a^*)^2+(b^*)^2]^{1/2}$$

[7. Reference Line and so on in Plan View]

From the viewpoint of describing the position of a region in which the saturation or the lightness is high, the shape of a head, and the like, reference lines, reference points and so on in a plan view are defined.

As shown in each plan view, the straight line C is a straight line that passes through the face center Fc and extends in the face-back direction. The positions of the high lightness region MR2, the high saturation region SR2, and the like can be determined with the straight line C as a reference.

As shown in FIG. 3 and so on, the point of intersection of the straight line C and the outline at the face side of the head is a point Pf. The point of intersection of the straight line C and the outline at the back side of the head is a point Pb. The midpoint of the line segment connecting the point of intersection Pf and the point of intersection Pb to each other is a point Pm. The midpoint Pm is also referred to as crown center.

As shown in FIG. 3 and so on, a straight line that passes through the crown center Pm and extends in the toe-heel direction is defined as a straight line V. The point of intersection of the straight line V and the outline at the toe side of the head is a point Pt. The point of intersection of the straight line V and the outline at the heel side of the head is a point Ph. The length of the line segment connecting the crown center Pm and the point of intersection Pt to each other is denoted by Lt. The length of the line segment connecting the crown center Pm and the point of intersection Ph to each other is denoted by Lh.

The back heel portion BH of the outline of the head is an outline from the vicinity of the hosel to the point Pb. As the back heel portion BH bulges to a larger extent, the length Lh increases, so that Lh/(Lh+Lt) increases.

A point Pz shown in FIG. 3 and so on is the center point of the opening of the hosel hole 12. The point Pz is the center of a circle formed by an upper edge 16 of the hosel hole 12. The line segment connecting the opening center point Pz and the point Pb to each other is defined as a line segment D, and the length of the line segment D is denoted by L1. The point that is located on the outline of the head and at the heel side with respect to the line segment D and farthest from the line segment D is a point Ps. The distance between the point Ps and the line segment D is denoted by L2.

As the back heel portion BH bulges to a larger extent, the distance L2 increases, so that L2/L1 increases.

[8. Image During Addressing]

During addressing, a golf player views a head. The shape of the head provides various images to the golf player. The images can influence swings. The images can influence the results of shots. When the image is an uncomfortable feeling, a swing is likely to become disordered. Due to the uncomfortable feeling, a mishit is likely to occur.

In the case of a head having a crown, the projection area of the head is large. In addition, the head having the crown has a high degree of freedom in designing the outline shape of the head. With the head having the crown, various images are likely to occur as compared to a head that does not have a crown.

One of the points to which a golf player is likely to pay attention during addressing is the outline shape at the back side of the head. The outline shape is conspicuous. Furthermore, the degree of freedom in designing the outline shape is high, and the outline shape is different per head. Thus, an outline shape that is likely to cause an uncomfortable feeling can be present for each golf player. In particular, it has been found that an uncomfortable feeling is likely to occur due to the outline shape of the back heel portion. It has been found that the following uncomfortable feelings (a) and (b) are present due to the outline shape.

(a) an uncomfortable feeling regarding ball capturing (b) an uncomfortable feeling regarding mishit by duffing Regarding the uncomfortable feeling (a), ball capturing is a concept regarding the direction of the face at impact. "Ball capturing is good" means that the face does not become open at impact and the ball is solidly hit. "Ball capturing is poor" means that the face becomes open at impact and a failure to solidly hit the ball is caused. By feeling that ball capturing is good during addressing, a natural swing can be made, so that a nice shot is likely to occur.

It has been found that the uncomfortable feeling (a) is likely to occur due to the outline shape of the back heel portion BH. In particular, it has been found that the following uncomfortable feeling (a1) is likely to occur in the case of a head shape in which the back heel portion BH bulges to a large extent.

(a1) an uncomfortable feeling in which ball capturing is felt to be poor

Regarding the uncomfortable feeling (b), it has been found that the following uncomfortable feeling (b1) is likely to occur particularly in the case of a head shape in which the back heel portion BH bulges to a large extent.

(b1) an uncomfortable feeling in which the sole surface of a portion at which the back heel portion BH bulges is felt to come into contact with the ground before impact The cause for occurrence of the uncomfortable feeling (b1) is as follows. Generally, particularly in the case of a club having a crown, the heel side of the head is positioned lower than the toe side of the head at impact. This is due to the setting of the lie angle of the club. When awareness that the back heel portion BH bulges is added under basic recognition that the heel side is positioned lower, an image in which the back heel portion BH comes into contact with the ground is likely to occur.

As described above, the uncomfortable feelings (a) and (b) are likely to occur due to the outline shape of the back heel portion BH. Particularly in the case of a head shape in which the back heel portion BH bulges to a large extent, the uncomfortable feelings (a1) and (b1) are likely to occur.

<Uncomfortable Feeling Inhibition Effect 1>

The line of sight of a golf player is likely to be directed to a region in which the lightness or the saturation is high. The attention to the back heel portion BH is reduced by providing a high lightness region or a high saturation region at the toe side. Thus, the uncomfortable feelings (a) and (b) due to the shape of the back heel portion BH are inhibited, and particularly, the uncomfortable feelings (a1) and (b1) are effectively inhibited.

<Uncomfortable Feeling Inhibition Effect 2>

As described above, the line of sight of a golf player is likely to be directed to a high lightness region or a high saturation region. In addition, the high lightness region looks nearer than the low lightness region. Similarly, the high saturation region looks nearer than the low saturation region. By providing the high lightness region or the high saturation region at the toe side, the toe side of the crown looks nearer. Therefore, during addressing, the head looks upright. Upright means a state where a lie angle is large. Generally, in the case where a club is upright, a line normal to the hitting surface is likely to be directed leftward (in the case of a club for a right-hander). Thus, the head that looks upright provides an image that capturing is good. As a result, by the head looking upright, the uncomfortable feeling (a1) in which capturing is felt to be poor is reduced.

[9. Position of High Saturation Region]

As described above, the area of the portion of the high saturation region SR2 at the toe side with respect to the straight line C is denoted by St, and the area of the portion of the high saturation region SR2 at the heel side with respect to the straight line C is denoted by Sh (see FIG. 4). By positioning the high saturation region SR2 at the toe side, the uncomfortable feelings are inhibited. From this viewpoint, the area St is preferably larger than the area Sh, and furthermore, St/Sh (see FIG. 4) is preferably not less than 1.5, more preferably not less than 1.6, and further preferably not less than 1.7. The area Sh may be zero. When the high saturation region SR2 is excessively displaced to the toe side, an uncomfortable feeling that a sense of looking upright is too strong can occur. From this viewpoint, the area Sh is preferably not zero, and St/Sh is preferably not greater than 3.5.

From the viewpoint of directing the line of sight of a golf player to the toe side, the maximum saturation portion SR1 is preferably located at the toe side with respect to the straight line C. From the viewpoint of separating the line of sight of a golf player from the outline at the back side of the head, the centroid CS of the maximum saturation portion SR1 is preferably located at the face side with respect to the straight line V (see FIG. 3).

[10. Position of High Lightness Region]

As described above, the area of the portion of the high lightness region MR2 at the toe side with respect to the straight line C is denoted by Mt, and the area of the portion of the high lightness region MR2 at the heel side with respect to the straight line C is denoted by Mh (see FIG. 6). As described above, by positioning the high lightness region MR2 at the toe side, the uncomfortable feelings are inhibited. From this viewpoint, the area Mt is preferably larger than the area Mh, and furthermore, Mt/Mh is preferably not less than 1.5, more preferably not less than 1.6, and further preferably not less than 1.7. The area Mh may be zero. When the high lightness region MR2 is excessively displaced to the toe side, an uncomfortable feeling that a sense of looking upright is too strong can occur. From this viewpoint, the area Mh is preferably not zero, and Mt/Mh is preferably not greater than 3.5.

From the viewpoint of directing the line of sight of a golf player to the toe side, the maximum lightness portion MR1 is preferably located at the toe side with respect to the straight line C. From the viewpoint of separating the line of sight of a golf player from the outline at the back side of the head, the centroid CM of the maximum lightness portion MR1 is preferably located at the face side with respect to the straight line V (see FIG. 5).

[11. Preferable Head Shape]

By the high lightness or high saturation region being located at the toe side, a golf player is less likely to be conscious of the outline shape of the back heel portion BH. Thus, the uncomfortable feelings due to the outline shape of the back heel portion BH are reduced.

Particularly, in the case of a head shape in which the back heel portion BH bulges to a large extent, the uncomfortable feelings (a1) and (b1) are likely to occur. Therefore, when the back heel portion BH bulges to a large extent, the uncomfortable feeling inhibition effect is further enhanced. From this viewpoint, Hh/(Ht+Hh) is preferably higher (see FIG. 7). Hh/(Ht+Hh) is preferably not less than 0.40, more preferably not less than 0.41, and further preferably not less than 0.42. In consideration of the limit of a degree of freedom in designing a shape, Hh/(Ht+Hh) is preferably not greater than 0.52, more preferably not greater than 0.51, and further preferably not greater than 0.50.

As described above, when the back heel portion BH bulges to a large extent, the uncomfortable feeling inhibition eff ect is further enhanced. From this viewpoint, Lh/(Lh+Lt) is preferably higher (see FIG. 3). Lh/(Lh+Lt) is preferably not less than 0.40, more preferably not less than 0.41, and further preferably not less than 0.42. In consideration of the limit of a degree of freedom in designing a shape, Lh/(Lh+Lt) is preferably not greater than 0.50, more preferably not greater than 0.49, and further preferably not greater than 0.48.

As described above, when the back heel portion BH bulges to a large extent, the uncomfortable feeling inhibition effect is further enhanced. From this viewpoint, L2/L1 is preferably higher (see FIG. 3). L2/L1 is preferably not less than 0.140, more preferably not less than 0.141, and further preferably not less than 0.142. In consideration of the limit of a degree of freedom in designing a shape, L2/L1 is preferably not greater than 0.162, more preferably not greater than 0.161, and further preferably not greater than 0.160.

[12. Others]

From the viewpoint of making the presence of the high saturation region SR2 at the toe side felt more in order to direct the line of sight to the toe side, the ratio of the area St (see FIG. 4) to the area Ht (see FIG. 7) is preferably higher. St/Ht is preferably not less than 0.20, more preferably not less than 0.25, and further preferably not less than 0.30. When St/Ht is excessively high, the high saturation region SR2 at the toe side is not conspicuous in some cases. From this viewpoint, St/Ht is preferably not greater than 0.95, more preferably not greater than 0.90, and further preferably not greater than 0.85.

From the viewpoint of making the presence of the high saturation region SR2 at the heel side felt less in order to direct the line of sight to the toe side, the ratio of the area Sh (see FIG. 4) to the area Hh (see FIG. 7) is preferably lower. Sh/Hh is preferably not greater than 0.70, more preferably not greater than 0.65, and further preferably not greater than 0.60. The area Sh may be zero. When Sh/Hh is excessively low, an uncomfortable feeling that a sense of looking upright is too strong occurs in some cases. From this viewpoint, Sh/Hh is preferably not less than 0.10, more preferably not less than 0.15, and further preferably not less than 0.20.

From the viewpoint of making the presence of the high lightness region MR2 at the toe side felt more in order to direct the line of sight to the toe side, the ratio of the area Mt (see FIG. 6) to the area Ht (see FIG. 7) is preferably higher. Mt/Ht is preferably not less than 0.20, more preferably not less than 0.25, and further preferably not less than 0.30. When Mt/Ht is excessively high, the high lightness region MR2 at the toe side is not conspicuous in some cases. From this viewpoint, Mt/Ht is preferably not greater than 0.95, more preferably not greater than 0.90, and further preferably not greater than 0.85.

From the viewpoint of making the presence of the high lightness region MR2 at the heel side felt less in order to direct the line of sight to the toe side, the ratio of the area Mh (see FIG. 6) to the area Hh (see FIG. 7) is preferably lower. Mh/Hh is preferably not greater than 0.70, more preferably not greater than 0.65, and further preferably not greater than 0.60. The area Mh may be zero. When Mh/Hh is excessively low, an uncomfortable feeling that a sense of looking upright is too strong occurs in some cases. From this viewpoint, Mh/Hh is preferably not less than 0.10, more preferably not less than 0.15, and further preferably not less than 0.20.

The size and basic shape of the head are different depending on the type of the head. Thus, a preferable value of the length Lh can change for each type of head.

In the case of a driver head, the length Lh (see FIG. 3) is preferably not less than 45 mm, more preferably not less than 47 mm, and more preferably not less than 49 mm. In consideration of the volume of the driver head, the length Lh is preferably not greater than 55 mm.

In the case of a fairway wood type head, the length Lh is preferably not less than 36 mm, more preferably not less than 37.5 mm, and more preferably not less than 39 mm. In consideration of the volume of the fairway wood type head, the length Lh is preferably not greater than 45 mm.

In the case of a hybrid type head, the length Lh is preferably not less than 36 mm, more preferably not less than 38 mm, and more preferably not less than 40 mm. In consideration of the volume of the hybrid type head, the length Lh is preferably not greater than 45 mm.

The coating region may have both the high lightness region MR2 and the high saturation region SR2. The coating region may have the high lightness region MR2 and may not have the high saturation region SR2. The coating region may have the high saturation region SR2 and may not have the high lightness region MR2. When either the high lightness region MR2 or the high saturation region SR2 is present, the above uncomfortable feeling inhibition effect is achieved.

From the viewpoint of attracting the line of sight of a golf player, the lightness of the high lightness region MR2 is preferably not less than 10, more preferably not less than 11, and further preferably not less than 12. From the viewpoint of preventing excessive change in lightness, the lightness of the high lightness region MR2 can be not greater than 95.

From the viewpoint of attracting the line of sight of a golf player, Lmax is preferably not less than 11, more preferably not less than 12, and further preferably not less than 13. From the viewpoint of preventing excessive change in lightness, Lmax can be not greater than 95.

From the viewpoint of attracting the line of sight of a golf player, the saturation in the high saturation region SR2 is preferably not less than 15, more preferably not less than 16, and further preferably not less than 17. From the viewpoint of preventing excessive change in saturation, the saturation in the high saturation region SR2 can be not greater than 80.

From the viewpoint of attracting the line of sight of a golf player, Cmax is preferably not less than 16, more preferably not less than 17, and further preferably not less than 18. From the viewpoint of preventing excessive change in saturation, Cmax can be not greater than 80.

A coating material used for coating the coating region may be one type or may be two or more types. Even with one type of coating material, the lightness or the saturation can be changed, for example, by performing coating with dots and changing the density of the dots. Preferably, two or more types of coating materials are used. From the viewpoint of making change in lightness or saturation easy, two or more types of colored coating materials are used.

Preferably, at least a part of the high lightness region MR2 is colored by a first coating material, and at least a part of the low lightness region MR3 is colored by a second coating material. Preferably, the lightness of the first coating material is greater than the lightness of the second coating material. Preferably, a region in which the first coating material and the second coating material overlap each other is present.

Preferably, at least a part of the high saturation region SR2 is colored by a first coating material, and at least a part of the low saturation region SR3 is colored by a second coating material. Preferably, the saturation of the first coating material is greater than the saturation of the second coating material. Preferably, a region in which the first coating material and the second coating material overlap each other is present.

An example of a preferable coating method includes: a first step of coating the entirety of the coating region with the second coating material; and a second step of coating a part of the coating region with the first coating material after the first step. Preferably, in the second step, the first coating material is applied by means of spray coating. Through the spray coating, a configuration in which the saturation or the lightness gradually changes from the center of a jet toward the surrounding is easily obtained.

An example of a preferable head is a driver head. The driver means a No. 1 wood (W#1). Normally, the driver head has the following configurations (1a) to (1d).

(1a) a face surface that is a curved surface (1b) a hollow portion (1c) a volume of not less than 300 cc and not greater than 460 cc (1d) a real loft of not less than 7 degrees and not greater than 14 degrees Another example of a preferable head is a fairway wood type head. Examples of fairway woods include a No. 3 wood (W#3), a No. 4 wood (W#4), a No. 5 wood (W#5), a No. 7 wood (W#7), a No. 9 wood (W#9), a No. 11 wood (W#11), and a No. 13 wood (W#13). Normally, the fairway wood type head has the following configurations (2a) to (2d).

(2a) a face surface that is a curved surface (2b) a hollow portion (2c) a volume of not less than 100 cc and less than 300 cc (2d) a real loft of greater than 14 degrees and not greater than 33 degrees More preferably, the head volume of the fairway wood type head is not less than 100 cc and not greater than 200 cc.

Still another example of a preferable head is a hybrid type head. The hybrid type head is also referred to as utility type head. Normally, the hybrid type head has the following configurations (3a) to (3d).

(3a) a face surface that is a curved surface (3b) a hollow portion (3c) a volume of not less than 100 cc and not greater than 200 cc (3d) a real loft of not less than 15 degrees and not greater than 33 degrees More preferably, the volume of the hybrid type head is not less than 100 cc and not greater than 150 cc.

The material of the head is not limited. Examples of the material of the head include metal and CFRP (carbon fiber reinforced plastic). Examples of the metal include one or more metals selected from pure titanium, a titanium alloy, stainless steel, maraging steel, an aluminum alloy, a magnesium alloy, and a tungsten-nickel alloy. Examples of stainless steel include SUS630 and SUS304. A specific example of stainless steel is CUSTOM450 (manufactured by Carpenter Technology Corporation). Examples of titanium alloys include 6-4 titanium (Ti-6Al-4V) and Ti-15V-3Cr-3Sn-3Al.

The method for producing the head is not limited. Normally, a hollow head is produced by joining together two or more members. The method for producing each member that forms the head is not limited, and examples thereof include casting, forging, and press forming.

Examples of the structure of the head include a two-piece structure in which two members each of which is integrally molded are joined together, a three-piece structure in which three members each of which is integrally molded are joined together, and a four-piece structure in which four members each of which is integrally molded are joined together.

The present disclosure is applicable to a golf club head having a crown, such as a wood type head, a hybrid type head, and the like.

The above descriptions are merely illustrative examples, and various modifications can be made.

What is claimed is:

1. A golf club head comprising a hitting surface having a face center, a crown having a coating region, a sole, and a hosel hole, wherein when a color in the coating region is represented by indexes L*, a*, and b* in a CIELAB color system and a saturation of the color is $((a^*)^2+(b^*)^2)^{1/2}$, the coating region has a maximum saturation portion at which the saturation is a maximum value Cmax, a high saturation region which includes the maximum saturation portion and in which a saturation difference from the saturation Cmax is not greater than 15, and a low saturation region in which a saturation difference from the saturation Cmax is greater than 15, the low saturation region surrounds the high saturation region, and in a plan view of the head, when a straight line that passes through the face center and extends in a face-back direction is defined as a straight line C, an area of a portion of the high saturation region at a toe side with respect to the straight line C is denoted by St, and an area of a portion of the high saturation region at a heel side with respect to the straight line C is denoted by Sh, the area St is larger than the area Sh.

2. The golf club head according to claim 1, wherein St/Sh is not less than 1.5.

3. The golf club head according to claim 1, wherein when a lightness of the color in the coating region is the index L*, the coating region has a maximum lightness portion at which the lightness is a maximum value Lmax, a high lightness region which includes the maximum lightness portion and in which a lightness difference from the lightness Lmax is not greater than 8.0, and a low lightness region in which a lightness difference from the lightness Lmax is greater than 8.0, the low lightness region surrounds the high lightness region, and in the plan view of the head, when an area of a portion of the high lightness region at the toe side with respect to the straight line C is denoted by Mt and an area of a portion of the high lightness region at the heel side with respect to the straight line C is denoted by Mh, the area Mt is larger than the area Mh.

4. The golf club head according to claim 3, wherein Mt/Mh is not less than 1.5.

5. The golf club head according to claim 1, wherein when a head area at the toe side with respect to the straight line C is denoted by Ht and a head area at the heel side with respect to the straight line C is denoted by Hh, Hh/(Ht+Hh) is not less than 0.40.

6. The golf club head according to claim 1, wherein the straight line C has a point of intersection Pf with an outline at a face side of the head, a point of intersection Pb with an outline at a back side of the head, and a midpoint Pm of a line segment connecting the point of intersection Pf and the point of intersection Pb to each other, and the midpoint Pm is defined as a crown center, a straight line that passes through the crown center and extends in a toe-heel direction is defined as a straight line V, the straight line V has a point of intersection Pt with an outline at the toe side of the head and a point of intersection Ph with an outline at the heel side of the head, a length of a line segment connecting the crown center and the point of intersection Pt to each other is denoted by Lt, and a length of a line segment connecting the crown center and the point of intersection Ph to each other is denoted by Lh, and Lh/(Lh+Lt) is not less than 0.40.

7. The golf club head according to claim 1, wherein when a line segment connecting a point of intersection Pb of an outline at a back side of the head and the straight line C and an opening center point Pz of the hosel hole to each other is defined as a line segment D, a length of the line segment D is denoted by L1, and a distance between the line segment D and a point Ps that is located on an outline of the head and at the heel side with respect to the line segment D and farthest from the line segment D is denoted by L2, L2/L1 is not less than 0.140.

8. The golf club head according to claim 1, wherein change in saturation from the maximum saturation portion to the low saturation region is continuous.

9. The golf club head according to claim 1, wherein a saturation in the high saturation region is not less than 15.

10. The golf club head according to claim 1, wherein the Cmax is not less than 16.

11. A golf club head comprising a hitting surface having a face center, a crown having a coating region, a sole, and a hosel hole, wherein when a color in the coating region is represented by indexes L*, a*, and b* in a CIELAB color system and a lightness of the color is L*, the coating region has a maximum lightness portion at which the lightness is a maximum value Lmax, a high lightness region which includes the maximum lightness portion and in which a lightness difference from the lightness Lmax is not greater than 8.0, and a low lightness region in which a lightness difference from the lightness Lmax is greater than 8.0, the low lightness region surrounds the high lightness region, and in a plan view of the head, when a straight line that passes through the face center and extends in a face-back direction is defined as a straight line C, an area of a portion of the high lightness region at a toe side with respect to the straight line C is denoted by Mt, and an area of a portion of the high lightness region at a heel side with respect to the straight line C is denoted by Mh, the area Mt is larger than the area Mh.

12. The golf club head according to claim 11, wherein Mt/Mh is not less than 1.5.

13. The golf club head according to claim 11, wherein when a saturation of the color in the coating region is $((a^*)^2+(b^*)^2)^{1/2}$, the coating region has a maximum saturation portion at which the saturation is a maximum value Cmax, a high saturation region which includes the maximum saturation portion and in which a saturation difference from the saturation Cmax is not greater than 15, and a low saturation region in which a saturation difference from the saturation Cmax is greater than 15, the low saturation region surrounds the high saturation region, and in the plan view of the head, an area of a portion of the high saturation region at the toe side with respect to the straight line C is denoted by St, and an area of a portion of the high saturation region at the heel side with respect to the straight line C is denoted by Sh, the area St is larger than the area Sh.

14. The golf club head according to claim 13, wherein St/Sh is not less than 1.5.

15. The golf club head according to claim 11, wherein change in lightness from the maximum lightness portion to the low lightness region is continuous.

16. The golf club head according to claim 11, wherein a lightness in the high lightness region is not less than 10.

17. The golf club head according to claim 11, wherein the Lmax is not less than 11.

* * * * *